US011969105B1

(12) United States Patent
Lian

(10) Patent No.: US 11,969,105 B1
(45) Date of Patent: Apr. 30, 2024

(54) INFLATABLE SEAT HAVING A BACKREST WITH A PLURALITY OF HORIZONTALLY INTERSPERSED PVC SANDWICH MESH FABRIC STRIPS

(71) Applicant: Xiangpeng Lian, Rongcheng (CN)

(72) Inventor: Xiangpeng Lian, Rongcheng (CN)

( * ) Notice: Subject to any disclaimer, the term of this patent is extended or adjusted under 35 U.S.C. 154(b) by 0 days.

(21) Appl. No.: 18/543,045

(22) Filed: Dec. 18, 2023

(30) Foreign Application Priority Data

Nov. 30, 2023 (CN) ..... 202311631267.6

(51) Int. Cl.
*A47C 4/54* (2006.01)
*A47C 5/12* (2006.01)

(52) U.S. Cl.
CPC . *A47C 4/54* (2013.01); *A47C 5/12* (2013.01)

(58) Field of Classification Search
CPC ..... A47C 4/54
USPC ..... 297/452.41, 284.6, DIG. 3, DIG. 8
See application file for complete search history.

(56) References Cited

U.S. PATENT DOCUMENTS 3,112,956 A * 12/1963 Schick ..... A47C 7/029 297/229
3,680,917 A * 8/1972 Harris ..... A47C 4/54 297/452.41
D494,770 S * 8/2004 Hillard ..... D6/368
7,270,377 B2 * 9/2007 Schmitz ..... B60N 2/643 297/452.32
2005/0187085 A1 * 8/2005 Webb ..... A63B 21/4037 482/142
2005/0269858 A1 * 12/2005 Leutert ..... B64D 11/0647 297/452.41
2006/0163935 A1 * 7/2006 Harris ..... A47C 4/54 297/452.41
2015/0250328 A1 * 9/2015 Brechet ..... A47C 3/16 137/15.01
2017/0332802 A1 * 11/2017 Stern ..... A61G 7/05769
2019/0269246 A1 * 9/2019 Youngblood ..... E04H 4/00
2022/0290340 A1 * 9/2022 Bell ..... A47C 27/081

FOREIGN PATENT DOCUMENTS

CH 704811 A1 * 9/2012 ..... A47C 1/146
CN 106543814 A * 3/2017
CN 113815291 A * 12/2021
(Continued)

OTHER PUBLICATIONS 9 page PDF of translation of CN 106543814-A. (Year: 2017).*
(Continued)

*Primary Examiner* — Robert Canfield

(57) ABSTRACT

An inflatable seat, including a main body made of an inflation brushed cloth and a side wall surrounding the main body; where the main body includes a first side and a second side opposite to each other, the side wall connecting the first side and the second side; the first side includes a first surface, and the second side includes a second surface; the main body bends to form a cushion and a backrest; the first surface includes multiple first surface regions, and the first side further includes multiple PVC sandwich mesh fabric regions arranged on the backrest, the PVC sandwich mesh fabric regions being each in the shape of an elongated strip and horizontally interspersed with the multiple first surface regions.

6 Claims, 3 Drawing Sheets

(56) References Cited

FOREIGN PATENT DOCUMENTS

| | | | | |
|---|---|---|---|---|
| CN | 116411464 | A | * | 7/2023 |
| CN | 219856312 | U | * | 10/2023 |
| CN | 220053146 | U | * | 11/2023 |

OTHER PUBLICATIONS 5 page PDF of machine translation of CN 220053146-U. (Year: 2023).*
4 page PDF of machine translation of CN219856312-U. (Year: 2023).*
8 page PDF of machine translation of CN 116411464-A. (Year: 2023).*
18 page PDF of machine translation of CN 1163815291-A. (Year: 2021).*

* cited by examiner

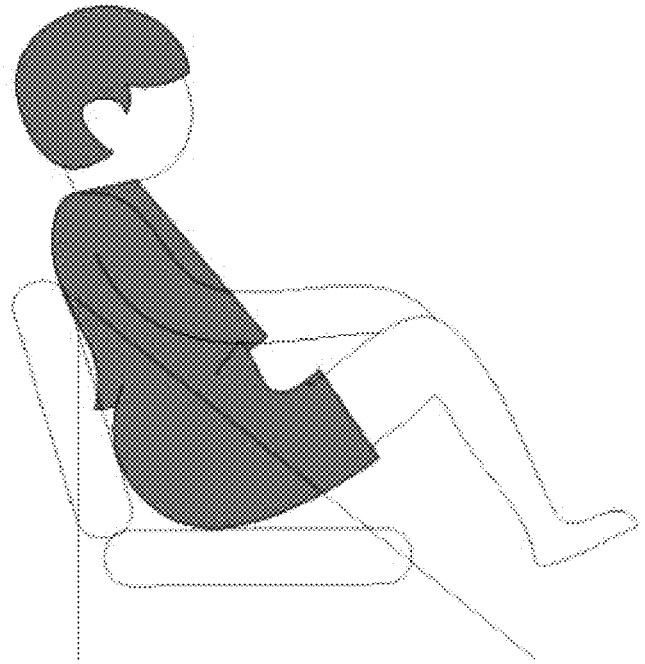
FIG. 1-- Prior Art --
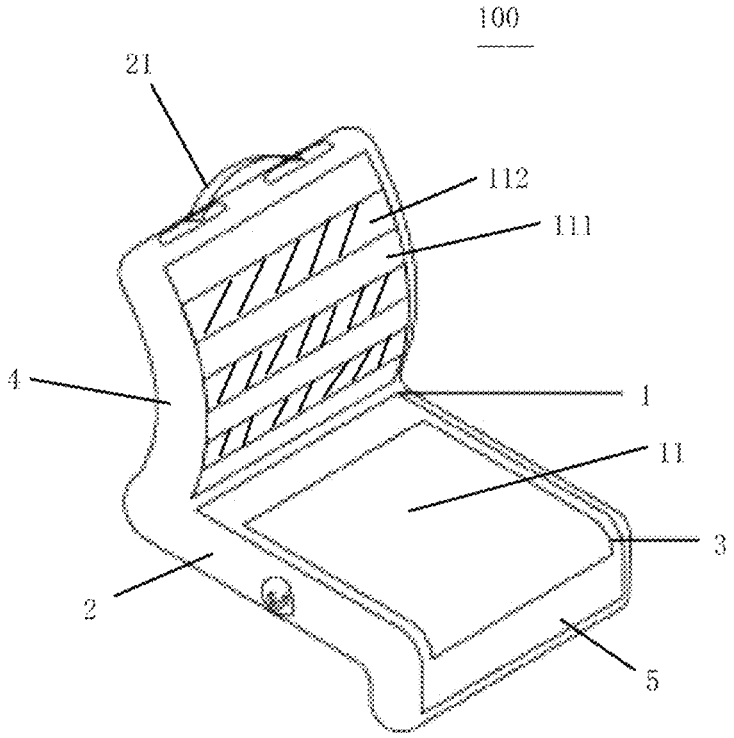
FIG. 2

INFLATABLE SEAT HAVING A BACKREST WITH A PLURALITY OF HORIZONTALLY INTERSPERSED PVC SANDWICH MESH FABRIC STRIPS

CROSS REFERENCE

The present disclosure claims priority of Chinese Patent Application No. 202311631267.6, filed on Nov. 30, 2023, the entire contents of which are hereby incorporated by reference in their entirety.

TECHNICAL FIELD

The present disclosure relates to technical field of household goods, especially relates to an inflatable seat and a manufacturing method thereof.

BACKGROUND

As the standard of living improves and there are more and more ways to relax, people's demand for comfortable home furnishings is also higher and higher. A conventional seat generally has its frame structure made of wood or metal, which is filled with sponge and covered with a pavement leather material. Although these seats are comfortable, they have a complex structure, cumbersome manufacturing process, and large volume, and large weight, which cannot be folded and is not easy to store and carry.

In order to maintain the comfort of the seat while making it easy to fold, inflatable seats have appeared on the market. However, a conventional inflatable seat does not have a backrest that conforms to the curvature of the human body's lumbar back region, which can easily cause lumbar spine pain and fatigue when sitting for a long time.

SUMMARY OF THE DISCLOSURE

Based on this, it is necessary to propose an inflatable seat which is comfortable to sit on and not easy to cause lumbar spine pain, and a manufacturing method thereof.

The present disclosure provides an inflatable seat, including a main body made of an inflation brushed cloth and a side wall surrounding the main body; wherein the main body includes a first side and a second side opposite to each other, the side wall connecting the first side and the second side; the first side includes a first surface, and the second side includes a second surface; the main body is bendable to form a cushion and a backrest; the first surface includes a plurality of first surface regions, and the first side further includes a plurality of PVC sandwich mesh fabric regions arranged on the backrest, the plurality of PVC sandwich mesh fabric regions being each in a shape of an elongated strip and horizontally interspersed with the plurality of first surface regions.

In some embodiments, the side wall is made of a PVC sandwich mesh fabric.

In some embodiments, the second side is arranged with an inflation port.

In some embodiments, the first side is arranged with a first horizontal stitching line below the plurality of PVC sandwich mesh fabric regions and a second horizontal stitching line below the first horizontal stitching line; the first horizontal stitching line is connected to the second horizontal stitching line, enabling the main body to bend forward.

In some embodiments, an upper end of the side wall is arranged with a carrying handle.

In some embodiments, the second side is arranged with a third horizontal stitching line and a fourth horizontal stitching line spaced apart from each other at a position away from the carrying handle; the third horizontal stitching line is connected to the fourth horizontal stitching line, enabling the main body to bend backward.

The present disclosure provides an inflatable seat, including a main body made of an inflation brushed cloth and a side wall surrounding the main body; where the main body includes a first side and a second side opposite to each other, the side wall connecting the first side and the second side; the first side includes a first surface, and the second side includes a second surface; the main body bends to form a cushion and a backrest; the first surface includes multiple first surface regions, and the first side further includes multiple PVC sandwich mesh fabric regions arranged on the backrest, the PVC sandwich mesh fabric regions being each in the shape of an elongated strip and horizontally interspersed with the multiple first surface regions. As the first surface is partially replaced with the PVC sandwich mesh fabric, the first side will naturally bend when the inflatable seat is in an inflated state, forming the backrest that conforms to the bending arc of the lumbar back region, which is comfortable to sit on and not easy for lumbar spine pain.

The present disclosure further provides a manufacturing method of an inflatable seat, including:

S100, providing a main body made of an inflation brushed cloth and conforming to a contour of the inflatable seat; wherein the main body includes a first side and a second side opposite to each other, the first face including a first surface and the second face including a second surface;

S200, selecting replacement regions on the first side, cutting to remove the first surface in the replacement regions, and sewing a PVC sandwich mesh fabric in the replacement regions to form a plurality of PVC sandwich fabric regions;

S300, sewing a PVC sandwich mesh fabric around a perimeter of the main body to form a side wall, wherein the side wall connects the first side and the second side; and

S400, selecting a first horizontal stitching line and a second horizontal stitching line below the plurality of PVC sandwich mesh fabric regions on the first side, folding the main body such that the first horizontal stitching line and the second horizontal stitching line overlap, and sewing the first horizontal stitching line and the second horizontal stitching line with a PVC sandwich mesh fabric.

In some embodiments, the manufacturing method further includes:

S500, mounting a carrying handle at an upper end of the side wall.

In some embodiments, the manufacturing method further includes:

S600, selecting a third stitching line and a fourth stitching line at a position away from the carrying handle on the second side, folding the main body such that the third horizontal stitching line and the fourth horizontal stitching line overlap, and sewing the third horizontal stitching line and the fourth horizontal stitching line with a PVC sandwich mesh fabric.

The manufacturing method of an inflatable seat provided by the present disclosure includes the steps of: providing a main body made of an inflation brushed cloth and conforming to a contour of the inflatable seat; where the main body includes a first side and a second side opposite to each other, the first face including a first surface and the second face including a second surface; selecting replacement regions on the first side, cutting to remove the first surface in the replacement regions, and sewing a PVC sandwich mesh fabric in the replacement regions to form multiple PVC sandwich fabric regions; sewing a PVC sandwich mesh fabric around a perimeter of the main body to form a side wall, where the side wall connects the first side and the second side, and the side wall is arranged with an inflation port; selecting a first horizontal stitching line and a second horizontal stitching line below the PVC sandwich mesh fabric regions on the first side, folding the main body such that the first horizontal stitching line and the second horizontal stitching line overlap, and sewing the first horizontal stitching line and the second horizontal stitching line with a PVC sandwich mesh fabric. Since the first surface is partially replaced with the PVC sandwich mesh fabric, the first side will naturally bend when the inflatable seat is in an inflated state, forming the backrest that conforms to the bending arc of the lumbar back region, which is comfortable to sit on and not easy for lumbar spine pain.

BRIEF DESCRIPTION OF THE DRAWINGS

In order to more clearly illustrate the technical solutions in the specific embodiments or related art of the present disclosure, the accompanying drawings to be used in the description of the specific embodiments or related art will be briefly introduced below. It will be obvious that the accompanying drawings in the following description are some of the embodiments of the present disclosure, and that for those skilled in the art, other attachments can be obtained based on these accompanying drawings without putting in creative labor.

FIG. 1 is a schematic view of a state of use of an inflatable seat in the related art.

FIG. 2 is a schematic view of an inflatable seat according to some embodiments of the present disclosure.

DETAILED DESCRIPTION

Figure 3:
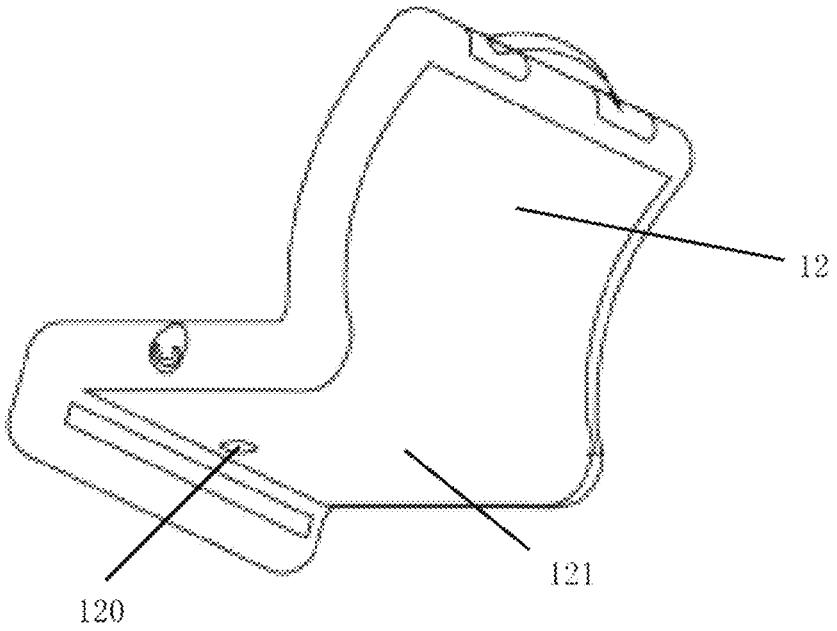
FIG. 3 is a schematic view of the inflatable seat shown in FIG. 2 in another viewing angle.
Figure 4:
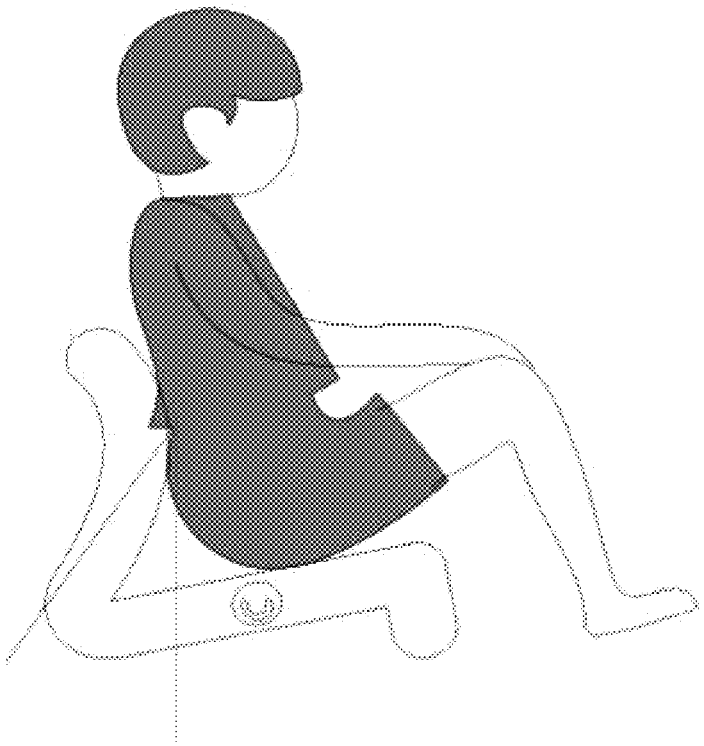
FIG. 4 is a schematic view of a state of use of an inflatable seat according to some embodiments of the present disclosure.

The following will be a clear and complete description of the technical solutions in the embodiments of the present disclosure in conjunction with the accompanying drawings in the embodiments of the present disclosure. Obviously, the described embodiments are only a part of the embodiments of the present disclosure, and not all of them. Based on the embodiments in the present disclosure, all other embodiments obtained by those skilled in the art without creative labor fall within the scope of the present disclosure.

In the description of the present disclosure, it is noted that when the terms "center", "up" "down", "left", "right", "vertical", "horizontal", "inner", "outer", etc. appear, they are indicative of an orientation or positional relationship based on that shown in the accompanying drawings, which is intended only to facilitate and simplify the description of the present disclosure and is not indicative of, or suggestive of, the necessity for the device or element referred to be of a particular orientation, or to be constructed and operated in a particular orientation, and therefore is not to be construed as a limitation of the present disclosure. Furthermore, the terms "first", "second", "third", if present, are used for descriptive purposes only and are not to be understood as indicating or implying relative importance.

An inflation brushed cloth is made by coating a layer of PVC film on each of front and back sides of a three-dimensional woven cloth, and front and back sides of a base cloth of the brushed cloth are each a flat fiber woven cloth. There are equally spaced long fiber filaments set up between the fiber woven cloths, such that the inflation brushed cloth can be made to maintain the front and back sides in parallel after inflation, and the inflation brushed cloth can be made to obtain a plate-like inflatable structural material after inflation.

FIG. 1 is a schematic view of a state of use of an inflatable seat in the related art. As shown in FIG. 1, a conventional inflatable seat includes an inflatable cushion and an inflatable backrest as two separate units. Because the inflatable backrest is usually straight and unbent, it is unable to provide support for the human lumbar and back, causing uncomfortableness after seating on the conventional inflatable seat for a long period of time.

As shown in FIGS. 2-5, some embodiments of the present disclosure provide an inflatable seat 100, including a main body 1 made of an inflation brushed cloth and a side wall 2 surrounding the main body; the main body 1 is bent to form a cushion 3 and a backrest 4. The main body 1 includes a first side 11 and a second side 12 opposite to each other, and the side wall 2 connects the first side 11 to the second side 12; the first side 11 includes a first surface 111, and the second side 12 includes a second surface 121; the first surface 111 includes multiple first surface regions, and the first side 11 further includes multiple PVC sandwich mesh fabric regions 112 arranged on the backrest 4, the multiple PVC sandwich mesh fabric regions 112 being each in the shape of an elongated strip and horizontally interspersed with the multiple first surface regions. Specifically, the backrest 4 is arranged with at least three PVC sandwich mesh fabric regions 112, each PVC sandwich mesh fabric region 112 spanning the first side 11 and connected to the side wall 2. In the embodiments, each of the three PVC sandwich mesh fabric regions 112 has a width of 3 cm. It can be appreciated that, in other embodiments, there may be four or more PVC sandwich mesh fabric regions 112 arranged, and the width of each PVC sandwich mesh fabric region 112 may vary, as long as allowing the backrest 4 to remain curved after inflation.

Since the main body 1 is made of inflation brushed cloth, it has the advantages of light weight, even stress distribution, good air tightness, etc., and is able to adjust the softness and hardness by an inflation degree, which is durable and easy to carry. The PVC sandwich mesh fabric has high tensile strength, high tear strength, and high stiffness, which can provide high resistance to compression and strong toughness.

In some embodiments, the side wall 2 is made of a PVC sandwich mesh fabric, and the second side 12 is arranged with an inflation port 120. Since the inflatable seat 100 has only one air chamber and there is only one inflation port 120, the problem of cumbersome operation of common inflatable furniture may be solved. The inflation port 120 is arranged on a bottom surface of the cushion 3, which may avoid the user from directly contacting the inflation port 120 made of plastic when sitting on the inflatable seat 100, thereby ensuring the usage experience.

In the embodiments, the first side 11 is arranged with a first horizontal stitching line 113 below the PVC sandwich mesh fabric regions 112 and a second horizontal stitching line 114 below the first horizontal stitching line 113; the first horizontal stitching line 113 is connected to the second horizontal stitching line 114, enabling the main body 1 to bend forward, such that the main body 1 above the first horizontal stitching line 113 forms the backrest 4, the main body 1 below the second horizontal stitching 114 forms the cushion 3. It will be appreciated that in other embodiments, the inflatable seat 100 may be made to maintain the bending of the main body 1 in an inflated state by arranged a strap on the side wall 2 on each of both sides. By sewing the first horizontal stitching 113 and the second horizontal stitching 114 with the PVC sandwich mesh fabric with high tensile strength, the main body can bend automatically when the inflatable seat 100 is inflated, which ensures the durability of the inflatable seat 100 and reduces the number of parts, thereby simplifying the steps of production and use of the inflatable seat 100.

In some embodiments, an upper end of the side wall 2 is arranged with a carrying handle 21, which facilitates the user to carry the inflatable seat 100 whether in an inflated state or a deflated state.

Further, the second side 12 is arranged with a third stitching line 123 and a fourth stitching line 124 spaced apart from each other at a position away from the carrying handle 21; the third horizontal stitching line 123 is connected to the fourth horizontal stitching line 124, such that the main body 1 is bent backward to form a supporting leg 5, so as to make the inflatable seat 100 applicable to a variety of different usage scenarios.

The present disclosure provides an inflatable seat, including a main body made of an inflation brushed cloth and a side wall surrounding the main body; where the main body includes a first side and a second side opposite to each other, the side wall connecting the first side and the second side; the first side includes a first surface, and the second side includes a second surface; the main body bends to form a cushion and a backrest; the first surface includes multiple first surface regions, and the first side further includes multiple PVC sandwich mesh fabric regions arranged on the backrest, the PVC sandwich mesh fabric regions being each in the shape of an elongated strip and horizontally interspersed with the multiple first surface regions. As the first surface is partially replaced with the PVC sandwich mesh fabric, the first side will naturally bend when the inflatable seat is in an inflated state, forming the backrest that conforms to the bending arc of the lumbar back region, which is comfortable to sit on and not easy for lumbar spine pain.

Figure 5:
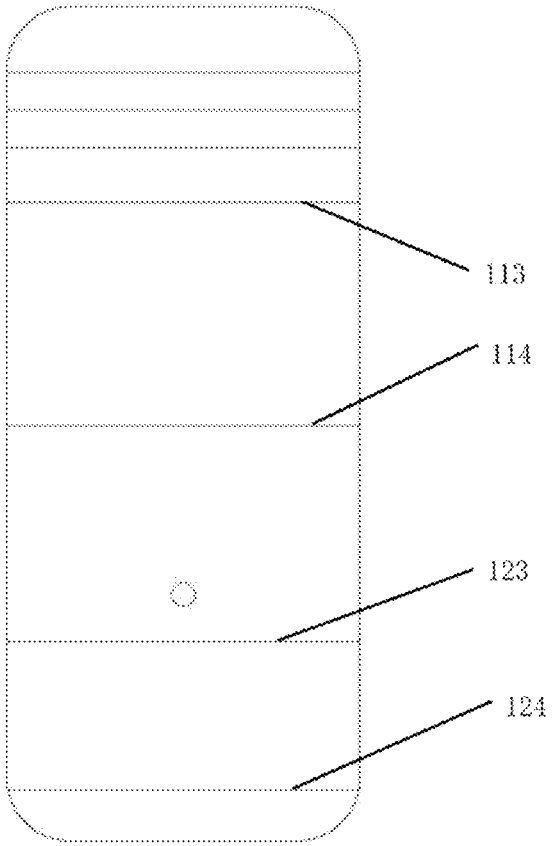
FIG. 5 is a schematic view of a body of an inflatable seat according to some embodiments of the present disclosure.

As shown in FIG. 5, the present disclosure further provides a manufacturing method of an inflatable seat, including the following steps.

S100, providing a main body made of an inflation brushed cloth and conforming to a contour of the inflatable seat; where the main body includes a first side and a second side opposite to each other, the first face including a first surface and the second face including a second surface;

S200, selecting replacement regions on the first side, cutting to remove the first surface in the replacement regions, and sewing a PVC sandwich mesh fabric in the replacement regions to form multiple PVC sandwich fabric regions;

S300, sewing a PVC sandwich mesh fabric around a perimeter of the main body to form a side wall, where the side wall connects the first side and the second side;

S400, selecting a first horizontal stitching line and a second horizontal stitching line below the PVC sandwich mesh fabric regions on the first side, folding the main body such that the first horizontal stitching line and the second horizontal stitching line overlap, and sewing the first horizontal stitching line and the second horizontal stitching line with a PVC sandwich mesh fabric.

Further, the manufacturing method further includes the following steps.

S500, mounting a carrying handle at an upper end of the side wall.

Further, the manufacturing method further includes the following steps.

S600, selecting a third stitching line and a fourth stitching line at a position away from the carrying handle on the second side, folding the main body such that the third horizontal stitching line and the fourth horizontal stitching line overlap, and sewing the third horizontal stitching line and the fourth horizontal stitching line with a PVC sandwich mesh fabric.

The manufacturing method of an inflatable seat provided by the present disclosure includes the steps of: providing a main body made of an inflation brushed cloth and conforming to a contour of the inflatable seat; where the main body includes a first side and a second side opposite to each other, the first face including a first surface and the second face including a second surface; selecting replacement regions on the first side, cutting to remove the first surface in the replacement regions, and sewing a PVC sandwich mesh fabric in the replacement regions to form multiple PVC sandwich fabric regions; sewing a PVC sandwich mesh fabric around a perimeter of the main body to form a side wall, where the side wall connects the first side and the second side, and the side wall is arranged with an inflation port; selecting a first horizontal stitching line and a second horizontal stitching line below the PVC sandwich mesh fabric regions on the first side, folding the main body such that the first horizontal stitching line and the second horizontal stitching line overlap, and sewing the first horizontal stitching line and the second horizontal stitching line with a PVC sandwich mesh fabric. Since the first surface is partially replaced with the PVC sandwich mesh fabric, the first side will naturally bend when the inflatable seat is in an inflated state, forming the backrest that conforms to the bending arc of the lumbar back region, which is comfortable to sit on and not easy for lumbar spine pain.

The above embodiments are only intended to illustrate the technical solution of the present disclosure, not to limit it; although the present disclosure has been described in detail with reference to the foregoing embodiments, those skilled in the art should understand that it is still possible to modify the technical solution recorded in the foregoing embodiments, or to replace some or all of the technical features with equivalent ones; and these modifications or replacements do not make the corresponding technical solution deviate from the essence of the technical solution of the present disclosure.

What is claimed is:

1. An inflatable seat, comprising a main body made of an inflation brushed cloth and a side wall surrounding the main body; wherein the main body comprises a first side and a second side opposite to each other, the side wall connecting the first side and the second side; the first side comprises a first surface, and the second side comprises a second surface; the main body is bendable to form a cushion and a backrest; the first surface comprises a plurality of first surface regions, and the first side further comprises a plurality of PVC sandwich mesh fabric regions arranged on the backrest, the plurality of PVC sandwich mesh fabric regions being each in a shape of an elongated strip and horizontally interspersed with the plurality of first surface regions.

2. The inflatable seat according to claim 1, wherein the side wall is made of a PVC sandwich mesh fabric.

3. The inflatable seat according to claim 1, wherein the second side is arranged with an inflation port.

4. The inflatable seat according to claim 1, wherein the first side is arranged with a first horizontal stitching line below the plurality of PVC sandwich mesh fabric regions and a second horizontal stitching line below the first horizontal stitching line; the first horizontal stitching line is connected to the second horizontal stitching line, enabling the main body to bend forward.

5. The inflatable seat according to claim 1, wherein an upper end of the side wall is arranged with a carrying handle.

6. The inflatable seat according to claim 5, wherein the second side is arranged with a third horizontal stitching line and a fourth horizontal stitching line spaced apart from each other at a position away from the carrying handle; the third horizontal stitching line is connected to the fourth horizontal stitching line, enabling the main body to bend backward.

* * * * *